United States Patent [19]

Dubis

[11] Patent Number: 4,662,594

[45] Date of Patent: May 5, 1987

[54] TRAY FOR USE WITH LADDERS

[76] Inventor: Ronald Dubis, 8368 Delhi Rd., Charleston Hgts., S.C. 29418

[21] Appl. No.: 671,862

[22] Filed: Nov. 15, 1984

[51] Int. Cl.[4] ..... E06C 7/14

[52] U.S. Cl. ..... 248/238; 248/231.2; 248/311.2

[58] Field of Search ..... 248/238, 231.2, 311.2, 248/210; 411/34, 37; 182/129, 120; 215/359; 403/227

[56] References Cited

U.S. PATENT DOCUMENTS

| | | | |
|---|---|---|---|
| 804,895 | 11/1905 | Spencer | 248/238 |
| 1,243,732 | 10/1917 | Goss | 248/210 X |
| 3,004,680 | 10/1961 | Moeller | 215/359 |
| 3,223,369 | 12/1965 | Benninger, Jr. | 248/210 |
| 3,721,463 | 3/1973 | Attwood et al. | 248/231.2 X |
| 4,186,903 | 2/1980 | Fazakerley | 248/231.2 X |
| 4,445,659 | 5/1984 | La Chance | 248/210 |
| 4,489,911 | 12/1984 | Riley | 248/238 |
| 4,523,733 | 6/1985 | Lunden, Jr. | 248/210 |

*Primary Examiner*—Ramon S. Britts
*Assistant Examiner*—Karen J. Chotkowski
*Attorney, Agent, or Firm*—B. Craig Killough

[57] ABSTRACT

A tray for use with ladders having hollow rungs opening to the side is disclosed, with the device being supported by a resilient member which is inserted into the rung and expanded against the inside of the rung by applying a compression force to the ends of the member, which holds the device firmly in place. The particular means for expanding the member disclosed herein uses the resilient characteristic of the member to "lock" the device in place.

3 Claims, 4 Drawing Figures

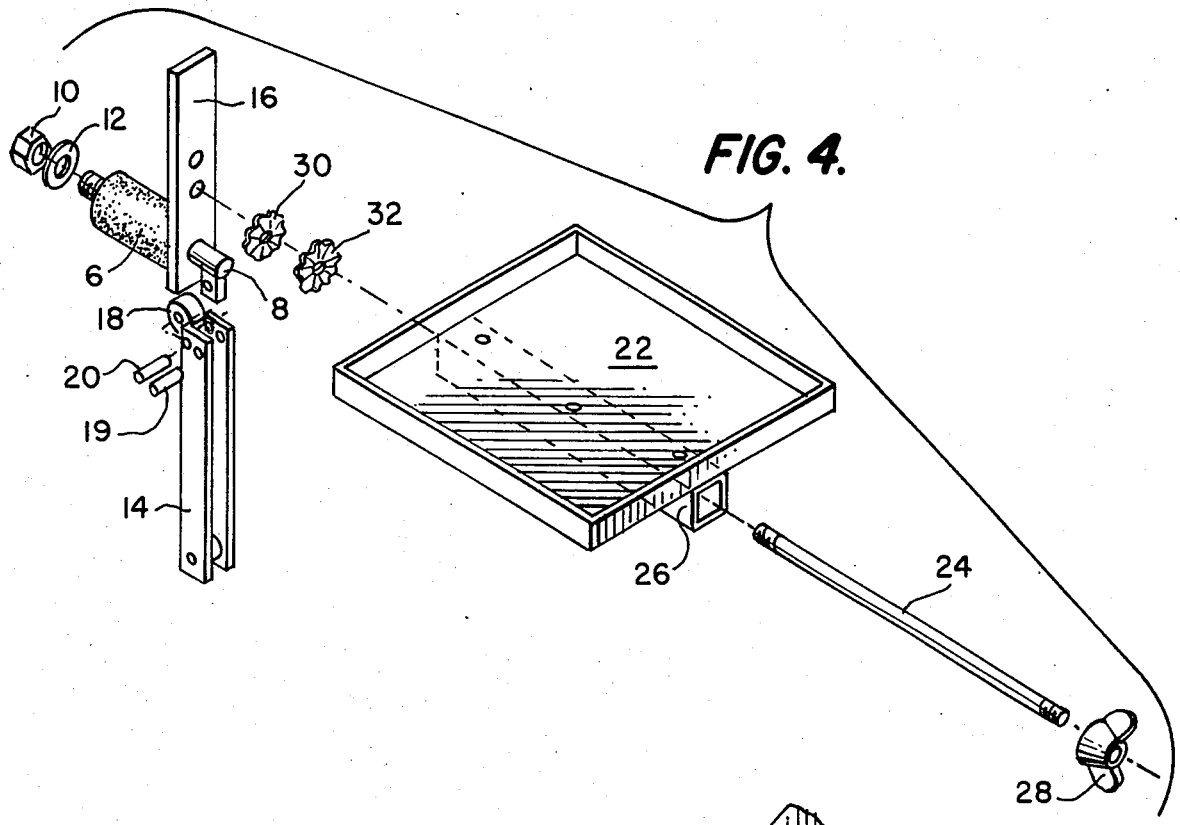
FIG. 4.
FIG. 3.
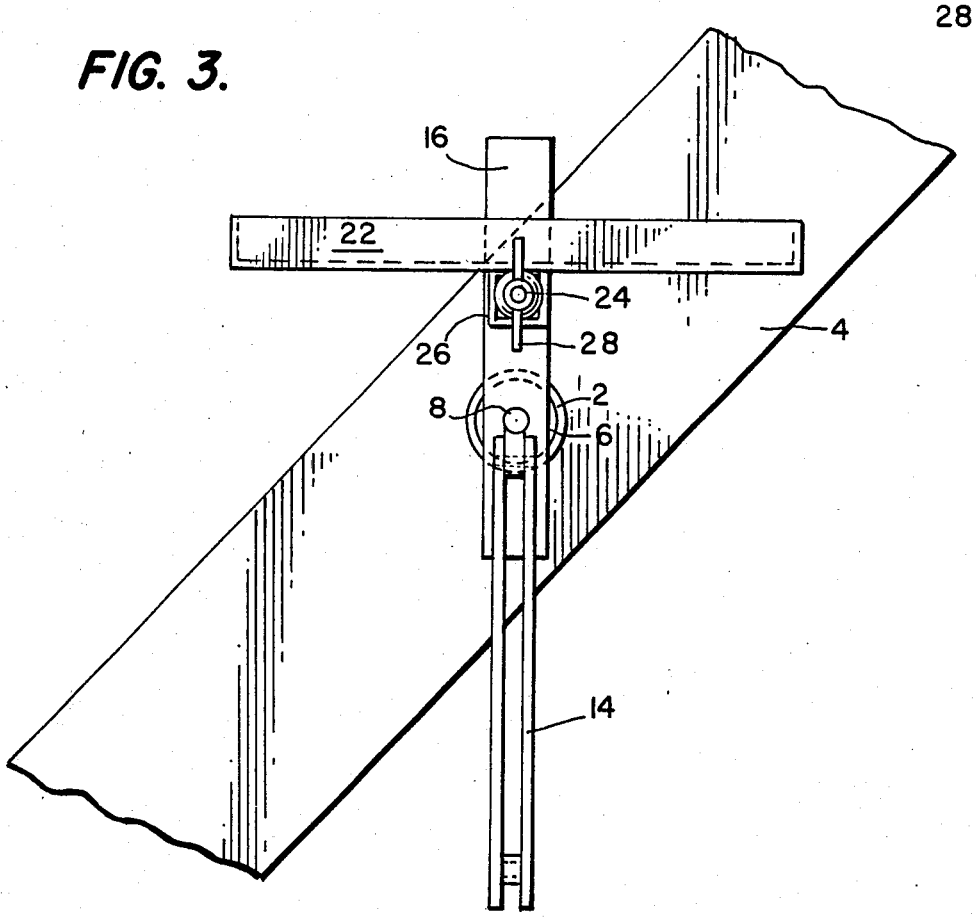

TRAY FOR USE WITH LADDERS

BACKGROUND AND SUMMARY OF THE INVENTION

A tray is disclosed herein which may be attached to a ladder and may be used to hold paint cans, tools and the like. The tray may be quickly and easily attached within the hollow rungs of a ladder at the work height.

Ladders presently in common use have rungs which are hollow and cylindrical, with the rungs opening to the sides or channels of the ladder. Ladders are used to allow work to be performed at elevations, and such work usually requires the use of tools or materials such as paint to be present at the work height. Climbing and holding onto a ladder is not conducive to holding and handling tools, equipment and materials.

The present invention provides a tray which may be quickly and easily inserted and positively attached within the rungs of a ladder, and provides a platform on which tools and materials may be placed. The tray may be quickly released from the rung, and moved to a higher or lower rung as is necessary to the activity. The angle of the tray relative to the ladder may be adjusted so that the tray is parallel to the ground.

DETAILED DESCRIPTION OF THE DRAWINGS

FIG. 3 is a side elevation of the ladder tray attached to a ladder, which is shown as a partial view.

FIG. 4 is an exploded view of the ladder tray.

DETAILED DESCRIPTION OF THE PREFERRED EMBODIMENT

Figure 1:
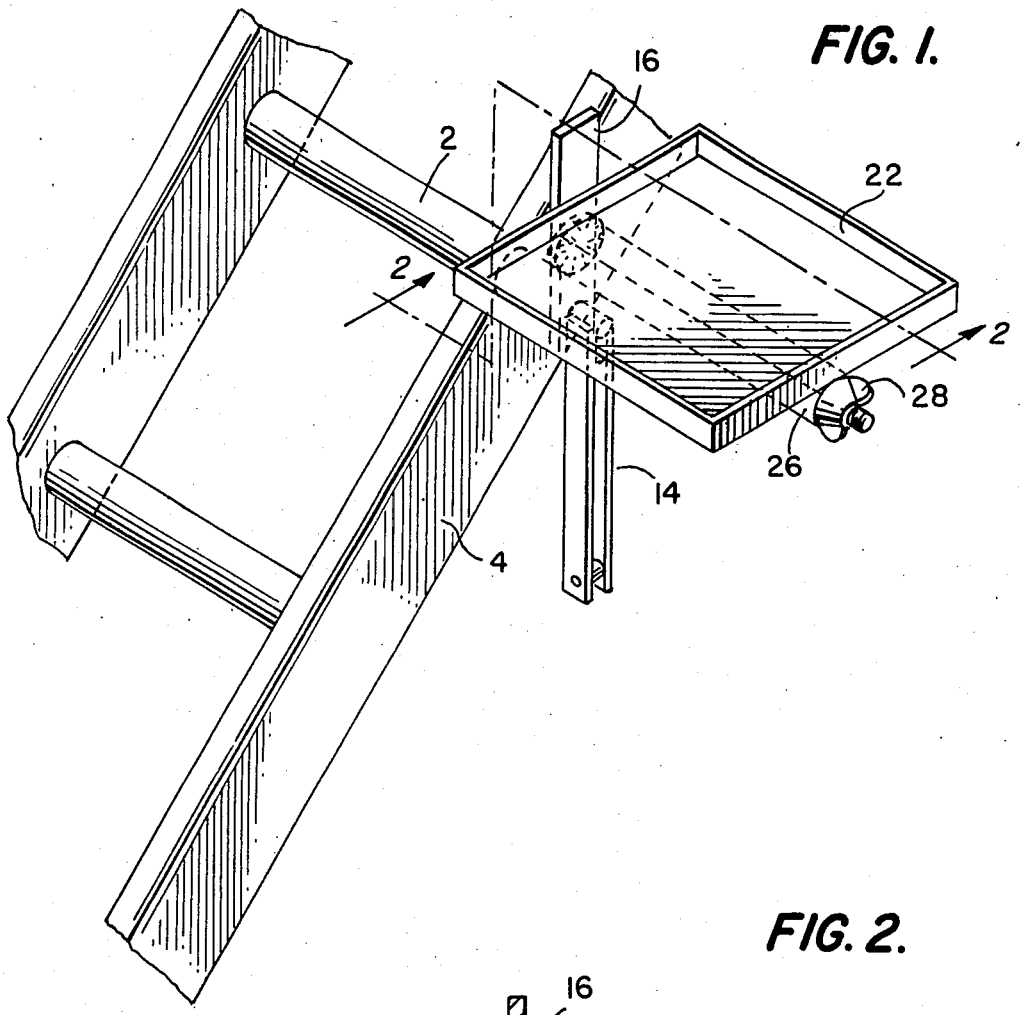
FIG. 1 is a perspective view of the ladder tray shown attached to a partial perspective view of a ladder.

This invention provides a tray which may be used in conjunction with and attached to a ladder having hollow, open rungs 2 to provide a tray or work base for use while working on the ladder. Ladders of the type described herein are commonly in use, and are typically made of lightweight aluminum, with the hollow rungs 2 opening to the sides 4 or channels, and joining the sides.

The invention has an expandable member 6 which is placed into the desired rung 2. This expandable member 6 is generally cylindrical in shape, and in its unexpanded condition, has a diameter which is slightly smaller than the diameter of the opening of the rung 2. The primary required characteristic of the expandable member is that it be of a material which, when squeezed from the ends, will expand about its circumference, so that it contacts the inside of the hollow rung. Materials which have this expandable characteristic, such as rubber or silicone, are very well suited for use as the expandable member, and due to the resilent characteristics of these materials, provide a high degree of grip on the inside of the rung. The length of the expandable member should be suitable to support the tray when weight is placed upon it, while taking full advantage of the expansive characteristic of the member. While the member 6 is shown as being cylindrical in shape, it could be triangular, square, semicylindrical or of other shape when viewed from the end.

The expandable member 6 is compressed in response to the movement of a bar 8 which runs through the member 6 in a slideable fashion, having an end which is bigger than the hole through the center of the expandable member so that when the end of the bar 8 is pulled against the expandable member 6, the end squeezes the expandable member, causing the member to expand about its circumference and against the rung. In the embodiment depicted in the drawings, this end is accomplished by threading the bar 8, and fitting a nut 10 and washer 12 on the threads.

Movement of bar 8 is accomplished by handle 14. The expandable member 6 is put into the ladder rung 2, and pushed in until the brace 16 contacts the side 4 of the ladder. The handle is then rotated 90° downward and about the bar (FIG. 2), sliding the bar 8 toward the outside of the ladder and compressing the member 6 against the brace 16. A roller 18 fitted with the handle 14 rolls against the brace 16 to aid movement of the handle 14. The handle 14 is mounted to the bar 8 in a pivotal fashion with a pin 19 so that the handle 14 starts out parallel to the bar 8, and then is pulled perpendicular to the bar 8. While the brace 16 is shown in FIGS. 1 and 3 as being perpendicular to the ground, it may be placed so as to follow the side 4 of the ladder.

Figure 2:
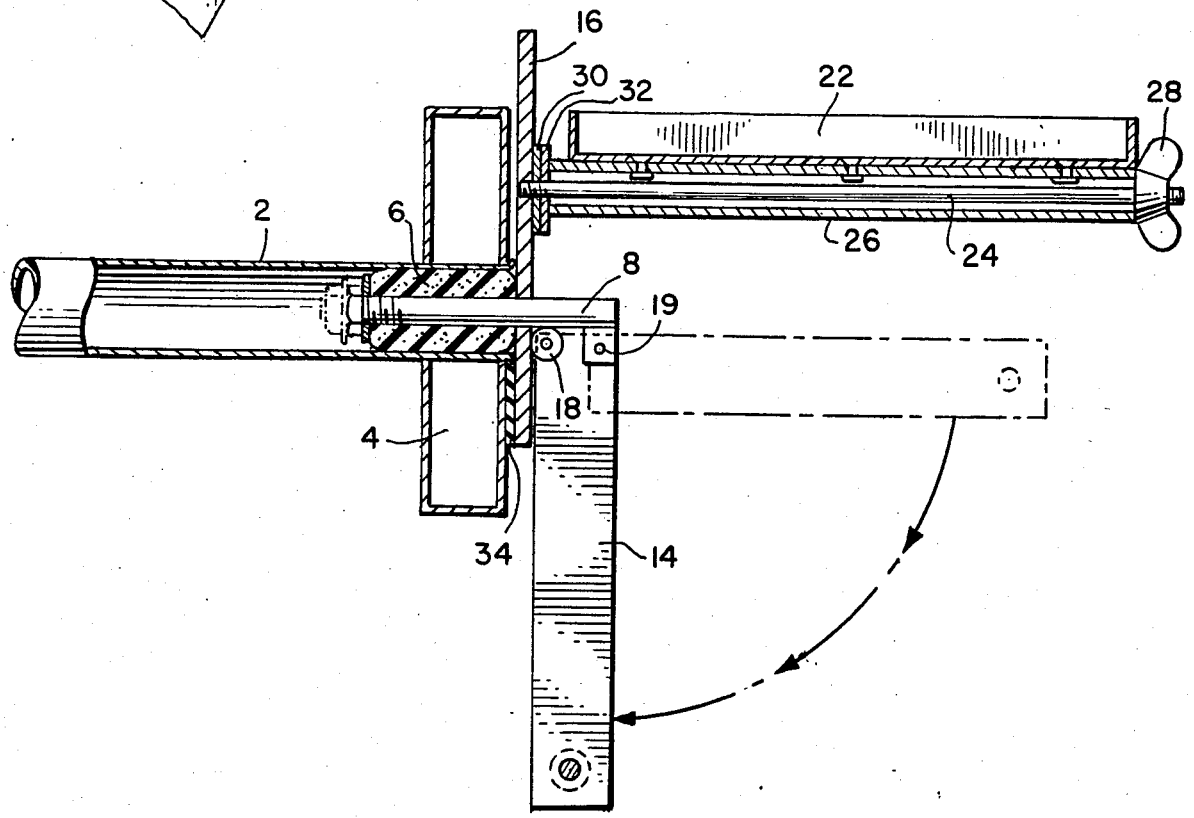
FIG. 2 is a side, sectioned view taken essentially along line 2—2 of FIG. 1, further showing the attachment action of the device.

The point of pivotal mounting of the handle 14 to the bar 8 is important in accomplishing this pulling action, and in "locking" the device in place. This particular pivotal relationship is depicted in FIG. 2. The length of the bar 8 is such that the top of the handle 14 is close to the brace when the member is in the uncompressed state. As the handle 14 is rotated downward, the roller 18 quickly contacts the brace 16 and rolls against it. When the handle reaches its fully vertical position, the force of the compressed member 6 holds the handle 14 in place since the handle 14 is largely between the pivot pin 19 and the compressed member 6. The pivot pin 19, which is mounted lower than the roller on the handle, transmits a force which pushes the roller 18 against the brace 16 and the bar 8, holding the handle 14 in place so that it does not counter rotate when the device is in its attached position.

On the upper end of the brace 16 the tray 22 is mounted. Different uses of the ladder will require different angles of the ladder, and the angle of the tray 22 must be capable of adjustment, since in most applications it is critical that the tray be parallel to the ground. This is accomplished by a rod 24 which is secured to the brace 16, around which the tray 22 may be rotated. Rod 24 runs through a tube 26 attached to the underside of the tray 22. A thumb screw 28 is threaded on the rod 24 so as to hold the tray 22 in place once the desired angle of the tray is achieved. A washer 30 having peaks and valleys may be attached to the brace, with a second washer 32 having peaks and valleys used in conjunction with it, so as to retard undesired rotation of the tray 22 due to the moment about the rod created when weight is placed in an uneven fashion on the tray. One or more rubber pads 34 placed between the brace and the ladder frame further aid in holding the device in place and aid in preventing rotation.

The device may be used on either side of the ladder, so long as the ladder is the type having hollow rungs with openings exposed. Other means for expanding the member 6 so as to hold it in place within the rung may be employed.

What is claimed is:

1. A ladder tray, comprising:

a. a member shaped so as to be capable of placement within a hollow ladder rung, and which expands about its circumference in response to compression by pressure being applied to each end thereof;

b. a bar slideably running through said member and being relatively large on one end thereof so as to apply pressure to said member upon said large end of said bar being pulled against said member;

c. a handle pivotally attached to said bar opposite said relatively large end, so that upon pivoting said handle said bar slides and pulls said relatively large end toward said member so as to compress said member;

d. a brace located between said member and said handle through which said bar is slideably located;

e. a roller rotatably mounted on said handle contacting said brace upon said handle being pivoted, facilitating pivoting of said handle, and causing said handle to to be held in place after being fully rotated by a force exerted upon said handle and said roller by said member under compression; and f. a tray attached to said brace.

2. A ladder tray as described in claim 1, further comprising a rubber pad attached to said brace opposite said handle so as to contact a ladder to aid in preventing rotation of said ladder tray.

3. A ladder tray as described in claim 1, wherein said brace may be placed within a channel of a ladder so as to aid in preventing rotation of said ladder tray.

* * * * *